US005949892A

United States Patent [19]

Stewart

[11] Patent Number: 5,949,892

[45] Date of Patent: Sep. 7, 1999

[54] METHOD OF AND APPARATUS FOR DYNAMICALLY CONTROLLING OPERATING CHARACTERISTICS OF A MICROPHONE

[75] Inventor: Brett B. Stewart, Austin, Tex.

[73] Assignee: Advanced Micro Devices, Inc., Sunnyvale, Calif.

[21] Appl. No.: 08/901,679

[22] Filed: Jul. 28, 1997

Related U.S. Application Data

[63] Continuation of application No. 08/568,979, Dec. 7, 1995, abandoned.

[51] Int. Cl.[6] ..... H04R 3/00

[52] U.S. Cl. ..... 381/113; 381/173; 381/174; 381/190; 381/191; 310/309; 310/324

[58] Field of Search ..... 381/113, 173–174, 381/190–191; 310/309, 324

[56] References Cited

U.S. PATENT DOCUMENTS

| | | | |
|---|---|---|---|
| 2,857,461 | 10/1958 | Brodie | 381/96 |
| 2,939,970 | 6/1960 | Dranetz et al. | 381/173 |
| 3,626,096 | 12/1971 | Von Muench et al. | 381/191 |
| 3,894,198 | 7/1975 | Murayama et al. | 381/190 |
| 4,242,541 | 12/1980 | Ando | 381/190 |
| 4,641,054 | 2/1987 | Takahata et al. | 381/190 |
| 4,712,247 | 12/1987 | Swarte | 381/96 |
| 5,327,504 | 7/1994 | Hobelsberger | 381/96 |
| 5,471,540 | 11/1995 | Maeda | 381/191 |
| 5,554,851 | 9/1996 | Hirai et al. | 310/309 |

*Primary Examiner*—Curtis A. Kuntz
*Assistant Examiner*—Duc Nguyen
*Attorney, Agent, or Firm*—Foley & Lardner

[57] ABSTRACT

A microphone has a diaphragm which vibrates in response to sound waves and a proximately positioned charge carrying circuit for dynamically controlling a compliance of the diaphragm. A micromachined microphone has a substrate, a compliant silicon membrane, and a charge carrying circuit positioned between the substrate and the membrane. A charge applied to the charge carrying circuit controls the compliance of the membrane thereby controlling operating characteristics of the microphone, such as dynamic range and frequency response.

10 Claims, 11 Drawing Sheets

METHOD OF AND APPARATUS FOR DYNAMICALLY CONTROLLING OPERATING CHARACTERISTICS OF A MICROPHONE

This application is a continuation, of application Ser. No. 08/568,979, filed Dec. 7, 1995 now abandoned.

BACKGROUND OF THE INVENTION

1. Field of the Invention

The invention relates to sound transducer devices, and more particularly to microphones with dynamically controllable operating characteristics. The invention further relates to a method of making and using such devices.

2. Related Art

Sound is propagated through a medium such as air by means of wave motion. Sound pressure level is the incremental variation from the static pressure in the air absent a sound wave. Each sound corresponds to a unique frequency which is the number of times a sound pressure varies from the static pressure level during a given time period. The cycle typically used is the Hertz (Hz) in which 1 Hz is equal to 1 cycle per second. A cycle is thus defined as a variation from equilibrium, a return to equilibrium, a negative variation from equilibrium, and a return to equilibrium. A sound travels through air as a wave at its corresponding frequency and sound pressure level.

A microphone is a sound wave transducer. A microphone typically includes a surface called a diaphragm which vibrates in response to sound waves incident thereon. The diaphragm is coupled to circuitry which translates the diaphragm vibrations into electrical signals which are proportional to the sound waves. In an electrostatic microphone the electrical signals are generated by detecting a variation of capacitance between the vibrating diaphragm and a fixed surface. For example, in a dc-biased electrostatic microphone, a capacitor is formed by two electrically conductive surfaces (a fixed backplate and the diaphragm) having an air gap between them and a voltage applied across them. An electret-biased electrostatic microphone is another example. This type of microphone also utilizes two surfaces to form a capacitor, but a permanently charged dielectric, such as Teflon®, is attached to the one of the surfaces. In one example, the dielectric is cemented onto the backplate and forms a capacitance with the diaphragm. In another example, the dielectric is metalized on one side and used as the diaphragm to form a capacitance with the backplate.

In both the dc-biased and electret-biased electrostatic microphones, sound waves produce a vibration of the diaphragm. Circuitry connected to the diaphragm then generates an output electrical signal corresponding to the variation of the capacitance. These signals are typically then further amplified and processed as required. Such microphones are used in numerous devices, such as telephones, tape recorders, and intercoms. More recently, computer-based devices have utilized microphones for speech recognition, tele-conferencing, and in multi-media systems.

The diaphragm of a conventional microphone has a fixed compliance defined by its mass, the stiffness of its material, and by the restoring forces applied to the diaphragm. The restoring forces include the resiliency of the diaphragm material, the mechanical tension on the diaphragm, and the acoustic stiffness of the air gap. In some microphones, the backplate is perforated with holes to decrease the acoustic stiffness of the air gap. As used herein, more compliant means more flexible and less compliant means less flexible.

To a large extent, the operating characteristics of a microphone depend upon the compliance of the diaphragm. For example, if sound waves in the vicinity of the microphone are not of sufficient sound pressure level to move the diaphragm against the restoring forces, the diaphragm will not move. Similarly, if the sound wave is not of sufficient frequency to overcome the restoring forces on the diaphragm, the diaphragm will not vibrate. On the other hand, if sound waves in the vicinity of the microphone have a sound pressure level that greatly exceeds the restoring forces on the diaphragm, the diaphragm will flex in response to the sound pressure but the position of the diaphragm will not accurately correspond to the instantaneous sound waves, and clipping distortion will occur. Similarly, if the sound wave has a frequency in excess of the diaphragm's ability to flex and return, the frequency of the diaphragm's vibration will not correspond to the frequency of the sound wave.

Two characteristics of a microphone which are based on the compliance of the diaphragm are its "dynamic range" and its "frequency response." The dynamic range is defined by the difference between the microphone's minimum sound pressure level (SPL) (the most quiet sounds detectable by the microphone), and its maximum SPL (the loudest sounds the microphone can convert to electrical signals without distortion). The frequency response is defined by the range of sounds the microphone can detect. For a typical microphone, these are within the spectrum of human hearing. For example, a silicon micromachined microphone such as the one provided by Noise Cancellation Technologies, Inc. has a dynamic range of 160 decibels (dB) (based on a minimum SPL -40 dB and a maximum SPL of 120 dB) and a frequency response of 20 Hz (the low end of the human hearing spectrum) to 10,000 Hz (the high end of human speech).

Within this general spectrum of characteristics, special purpose microphones are commercially available with specific operating characteristics optimized for use in various applications. However, a microphone which is optimized for one application may not be suitable for another application. For example, a spectrum of typical sound pressure levels measured in dBs can include a quiet office, with a SPL of approximately 30 dB; ordinary human conversation, with an SPL of approximately 40–50 dB; and factory machinery, with an SPL of approximately 80 dB. Therefore, a microphone with a maximum SPL of 60 dB will be a good microphone for a speakerphone in a quiet office, but will be a poor microphone for an intercom on a factory floor. On the other hand, a microphone with a minimum SPL of 60 dB and a maximum SPL of 120 dB will be a good microphone for an intercom on a factory floor, but will be a poor microphone for use in a speakerphone in a quiet office.

Many microphones may be subject to a variety of conditions. A conventional microphone with fixed operating characteristics may not operate effectively across the entire range of conditions for a particular application. For example, an environment such as a factory floor has generally noisy conditions, but may also be occasionally quiet such as during breaks or after working hours. Thus, an intercom might be optimized to communicate between the factory floor and other areas of the factory when the factory is noisy. Such an intercom, which typically comprises a microphone, a speaker, and associated circuitry to facilitate communication with other intercoms, may operate poorly when the factory is quiet, due to its fixed operating characteristics.

In operation, a person wishing to communicate via the intercom speaks in the vicinity of the microphone. The microphone operating as a conventional microphone as described above, produces an electrical signal which is transmitted to another intercom where it is amplified to drive a speaker and be heard by a listener.

When the factory floor is noisy, a person trying to communicate therefrom must shout to be heard above the noise. Because the person speaking must shout, an intercom optimized for the factory floor will have a microphone with a relatively high maximum SPL. As discussed above, to achieve a high maximum SPL the compliance of the diaphragm must be relatively stiff. This is satisfactory for when the factory floor is noisy, however, a stiffer compliance also results in a higher minimum SPL. The higher minimum SPL, which is the lowest sound pressure level which will cause the diaphragm to vibrate, requires a greater sound pressure level to vibrate the diaphragm.

With a microphone as described above, when the factory floor is quiet, a person would still have to speak loudly to effectively use the intercom which was designed to operate optimally in a noisy factory environment. Therefore, such a microphone cannot operate optimally across the range of operating conditions. Furthermore, other areas of the factory which communicate through the intercom system may include a relatively quiet office. Since the microphone for the office will optimally have a lower maximum and minimum SPL, the same type of intercom unit cannot be used optimally in both the factory floor and the office environments.

Another example of a variable environment is in the area of computer-based microphone applications. It is sometimes desirable, such as in a speech recognition application, to have the microphone optimized for the speech of a specific person. Alternatively, it is sometimes desirable to have the microphone respond to a broader range of sounds, such as in a multi-party tele-conferencing application. In order to have the microphone respond to the speech of a specific person, a highly directional microphone is used and the person should speak in close proximity to the microphone. An omni-directional microphone, on the other hand, cannot typically focus on one specific person without also picking up sounds from other directions, such as in the vicinity of the speaker.

When sound conditions in an environment vary, a microphone with fixed operating characteristics may be unable to operate effectively in certain variations of the environment. A microphone with dynamically controllable operating characteristics is therefore needed to provide the flexibility to optimize the microphone to operate effectively in each variation of the environment.

SUMMARY AND OBJECTS OF THE INVENTION

It is an object of the invention to provide a microphone with dynamically controllable operating characteristics. These include, among other characteristics, the maximum SPL, the minimum SPL, the dynamic range, and the frequency response of the microphone.

More generally, it is an object of the invention to control a compliance of a diaphragm in a sound transducer device.

These and other objects of the invention are accomplished by a microphone, including a diaphragm mounted therein which vibrates in response to sound waves, with means for dynamically controlling a compliance of the diaphragm.

In one embodiment according to the invention, a charge carrying circuit is positioned proximate to the diaphragm to dynamically control the compliance of the diaphragm and thereby control the operating characteristics of the microphone.

In another embodiment according to the invention, a micromachined microphone has a charge carrying circuit positioned in a depression between a compliant silicon membrane and a substrate. The charge carrying circuit may comprise, for example, concentric charge carrying rings. In another variation, the circuit may be embedded within the substrate.

BRIEF DESCRIPTION OF THE DRAWINGS

The above and other objects are accomplished according to the invention described herein with reference to the drawings in which.

DETAILED DESCRIPTION

Figure 1A:
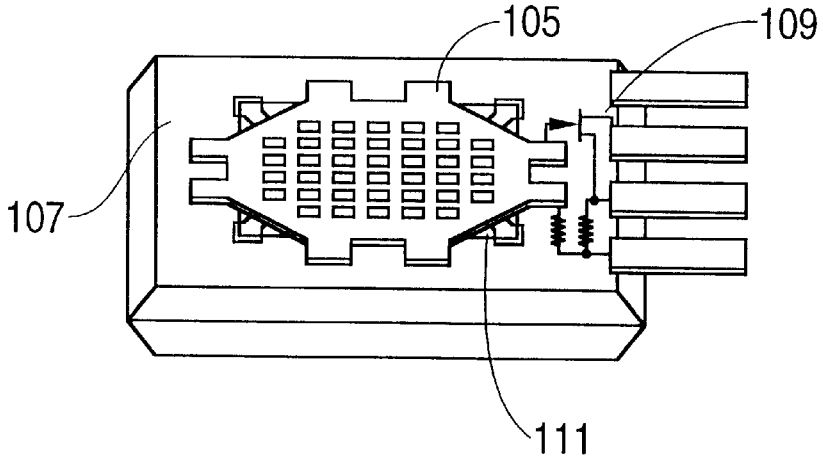
FIG. 1a (PRIOR ART)
FIG. 1*a* is a conventional micromachined microphone.
Figure 1B:
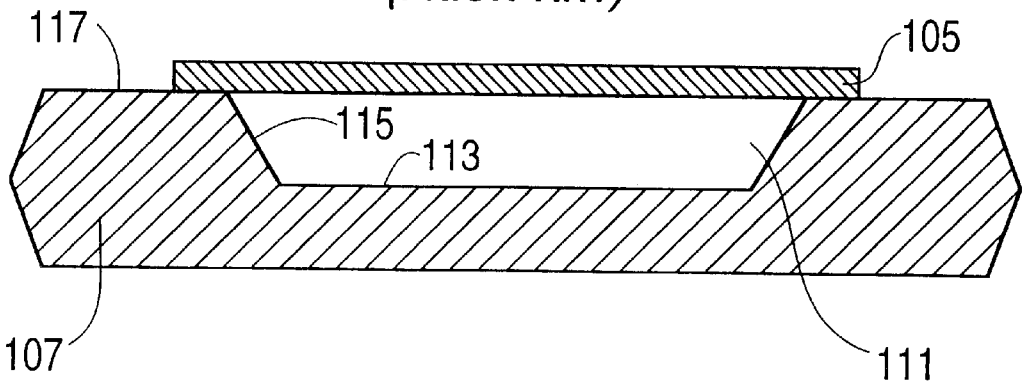
FIG. 1b (PRIOR ART)
FIG. 1*b* shows a cross section of a conventional micromachined microphone.

A conventional micromachined microphone is shown in FIGS. 1*a* and 1*b*. Such a microphone consists of a compliant silicon membrane 105 non-conductively attached to a substrate 107. The membrane 105 is coupled to circuitry 109. The substrate 107 forms a depression 111 underneath the membrane 105 which allows the membrane 105 to vibrate in response to sound waves. Thus, the membrane 105 functions as a diaphragm. The substrate 107 has conductive and non-conductive areas. In the area of the depression 111, for example, the bottom surface 113 may be a conductive surface, while the side walls 115 and the top surface 117 may be non-conductive. Other conductive areas of the substrate 107 may comprise the circuitry 109.

The membrane 105 and substrate 107 function together as plates of a capacitor. The vibration of the membrane 105 causes the capacitance to vary. The circuitry 109 responds to the variable capacitance and produces an electrical signal which is proportional to the sound waves vibrating the membrane 105. The operating characteristics of such a microphone are fixed once the microphone has been manufactured.

A microphone according to the invention, as disclosed herein includes a membrane and a substrate and further includes a charge carrying circuit which acts to apply a force on the membrane. A principal feature of the microphone according to the invention is that the microphone can be dynamically adapted to many different applications by controlling the charge applied to the charge carrying circuit.

Figure 2A:
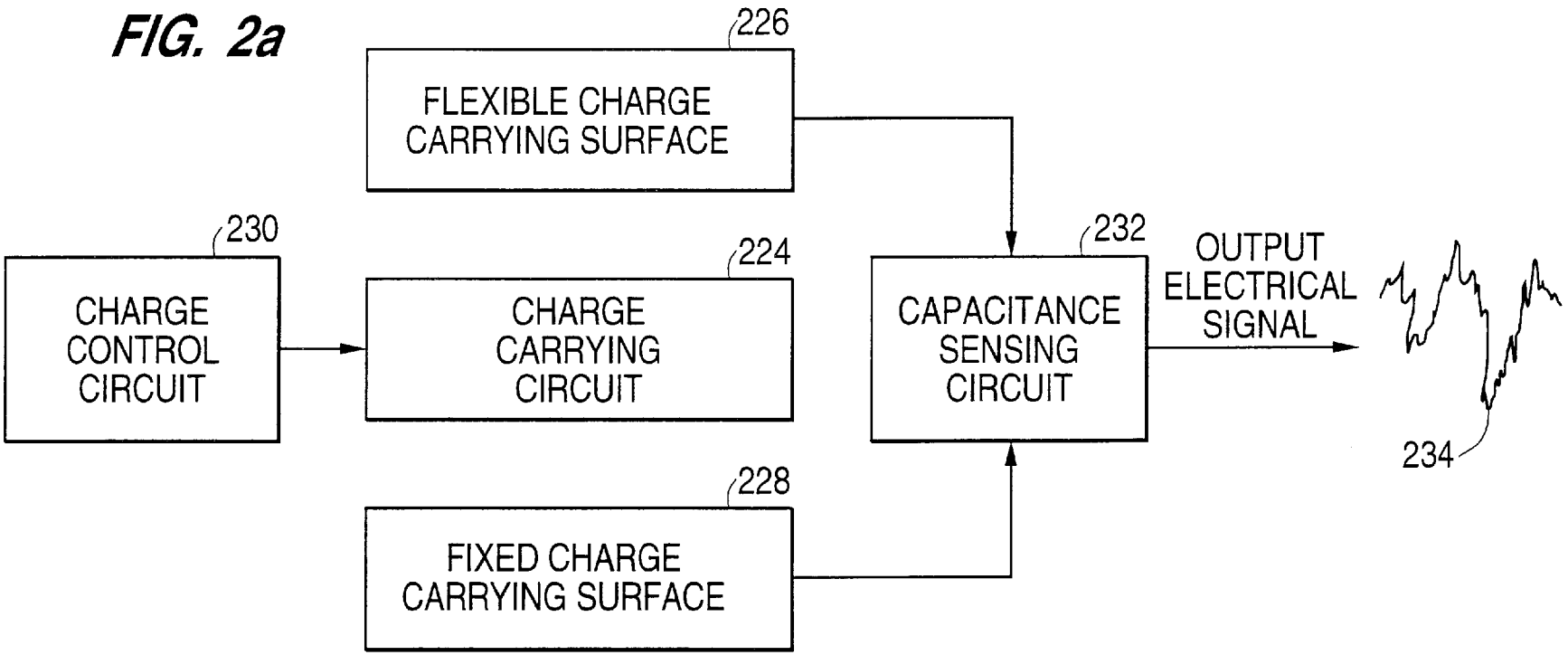
FIG. 2*a* is a block diagram of a microphone according to the invention.

In FIG. 2*a* a block diagram of a microphone according to the invention shows a flexible charge carrying surface 226 (the diaphragm) and a fixed charge carrying surface 228 coupled to a capacitance sensing circuit 232. This microphone further includes a charge carrying circuit 224 coupled to a charge control circuit 230. The charge carrying circuit 224 is positioned proximate to the flexible charge carrying surface 226, such that a charge applied by the charge control circuit 230 to the charge carrying circuit 224 imparts a force on the flexible charge carrying surface 226. Sound waves incident upon flexible charge carrying surface 226 cause the surface 226 to vibrate thereby causing a variation in the capacitance between the flexible surface 226 and the fixed surface 228. Capacitance sensing circuit 232 produces output electrical signal 234 which corresponds to the variance of the capacitance.

Figure 2C:
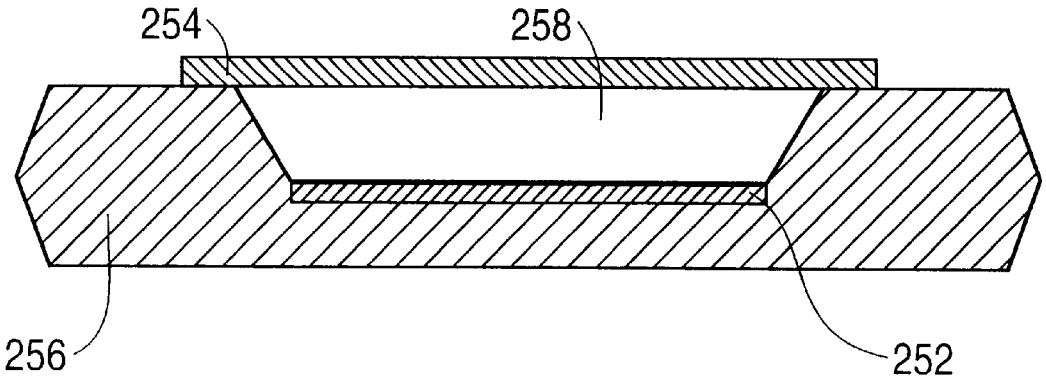
FIG. 2*c* shows a cross section of a second embodiment according to the invention.
Figure 2B:
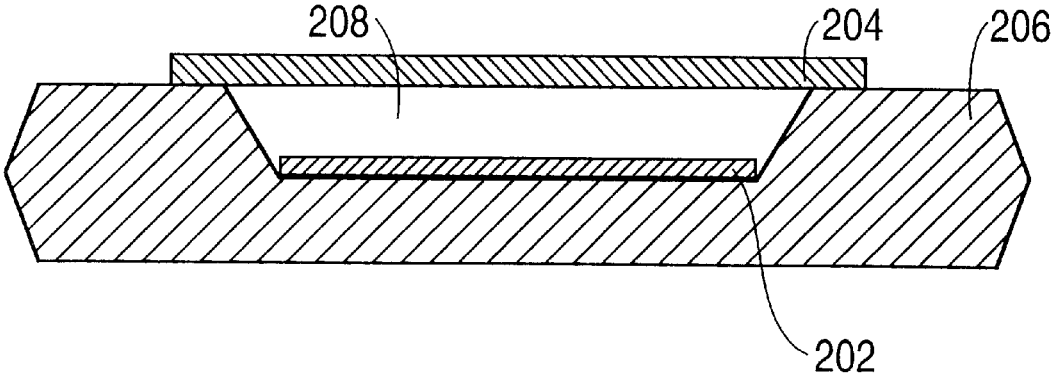
FIG. 2*b* shows a cross section of a first embodiment according to the invention.

Referring to FIG. 2*b*, a first embodiment of a microphone according to the invention has a membrane 204, a substrate 206, a depression 208 formed in substrate 206, and a charge carrying circuit 202 positioned in the depression 208 between the membrane 204 and the substrate 206. The charge carrying circuit 202 is placed proximate to the membrane 204 such that a charge applied to the circuit 202 applies either a repulsive or attractive force on the membrane 204. The compliance of the membrane 204 can thus be effectively controlled by varying the amount of charge on circuit 202. The operating characteristics of a microphone of the invention are therefore dynamic and can be controlled by a user after the microphone is manufactured.

In the embodiment of FIG. 2*b*, the circuit 202 is shown immediately adjacent to the substrate 206. It will be appreciated, however, that this is one exemplary position for circuit 202. Alternatively, circuit 202 could be located, for example, at other positions within the depression 208, at positions within the substrate 206, or at positions outside the microphone, such as above membrane 204 or below substrate 206. For example, FIG. 2*c* shows a second embodiment according to the invention having a membrane 254, a substrate 256, and a charge carrying circuit 252 which is embedded within substrate 256.

By controlling the compliance of the membrane, the microphone according to invention controls the minimum and maximum sound pressure level that the membrane can effectively respond to and can thereby tune a dynamic of the microphone to a desired range. An advantage of the invention is that such tuning is achieved without changing the frequency response of the microphone.

Figure 3:
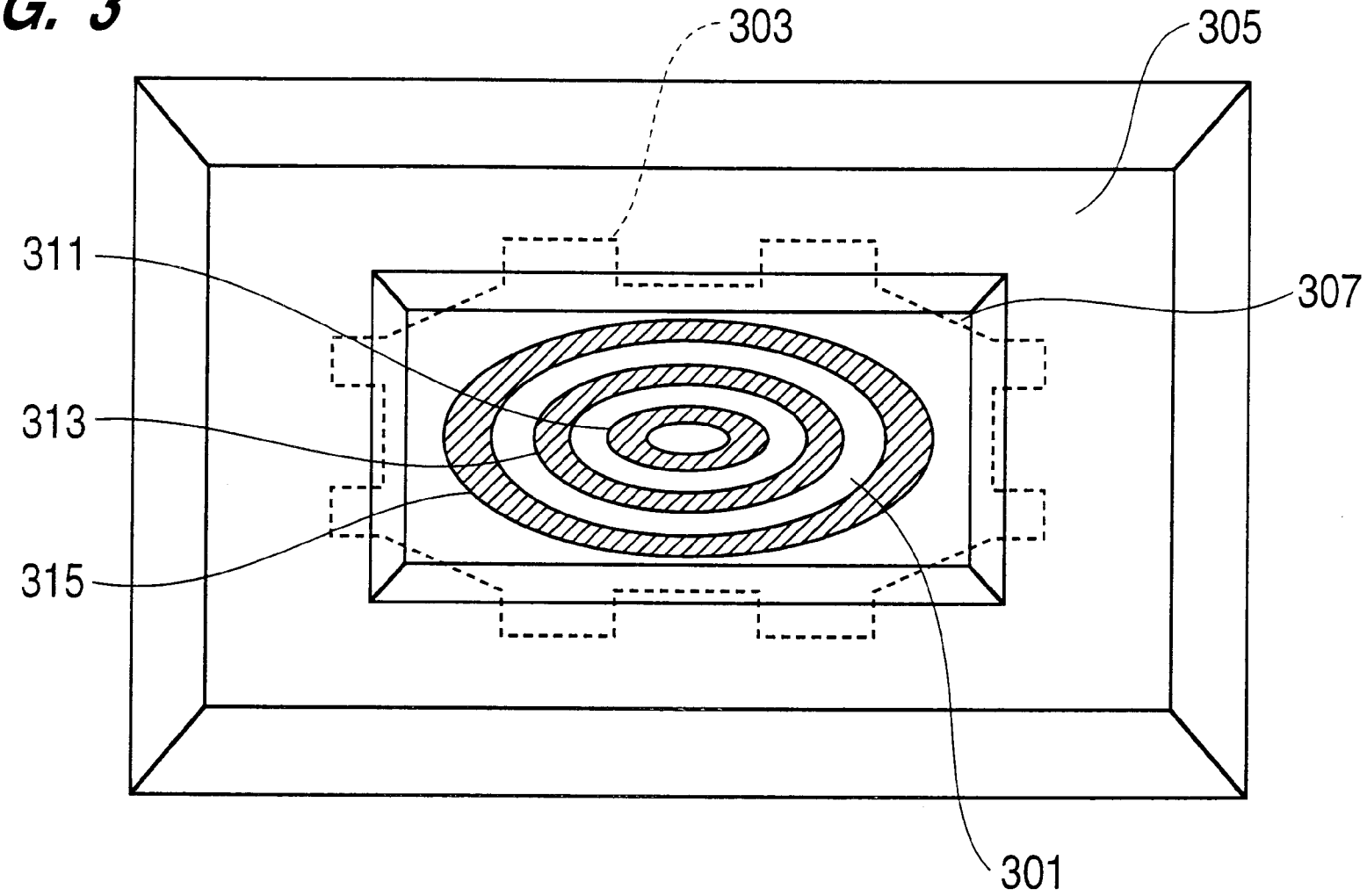
FIG. 3 is a top view of a third embodiment according to the invention.

FIG. 3 shows a third embodiment of a microphone according to the invention. This embodiment includes a membrane 303, a substrate 305, and a charge carrying circuit 301 positioned in a depression 307. The charge carrying circuit 301 includes concentric charge carrying rings 311, 313, and 315. The charge carrying circuit of FIG.3 has three rings, 311, 313, and 315, which are of substantially equal width and spacing. Other numbers of rings and variations of widths and spacings are of course possible.

An advantage is provided by the ability to selectively charge individual rings with various degrees of charge. The charge carrying circuit 301 offers more precise control over the compliance of the membrane compared, for example, with a charge carrying circuit having a single surface such as an oval. In a single charge carrying surface, the charge is uniformly spread across the entire surface of the charge carrying circuit, thus applying a uniform force to the entire membrane. With the concentric charge carrying rings 301 according to the invention, the charge on each ring can be individually controlled. A charge applied to outermost ring 315 applies a force principally to the outermost portion of the membrane 303. The inner portion of the membrane 303 remains relatively compliant compared to the compliance of the inner portion when a uniform charge is applied across the entire membrane. Alternatively, a first charge could be applied to outermost ring 315, while a second charge is applied to middle ring 313, and a third charge is applied to innermost ring 311. For example, applying progressively smaller charges to the rings from the outermost ring 315 to the inner most ring 311 renders the inner portions of the membrane less compliant than they would be with no charge applied, but more compliant than the outer portions of the membrane.

By controlling the compliance of the membrane, the microphone according to invention controls the effective geometry of the membrane and can thereby tune a frequency response of the microphone to a desired range. An advantage of the invention is that such tuning is achieved without additional circuitry required for a conventional band-pass filter.

Figure 4A:
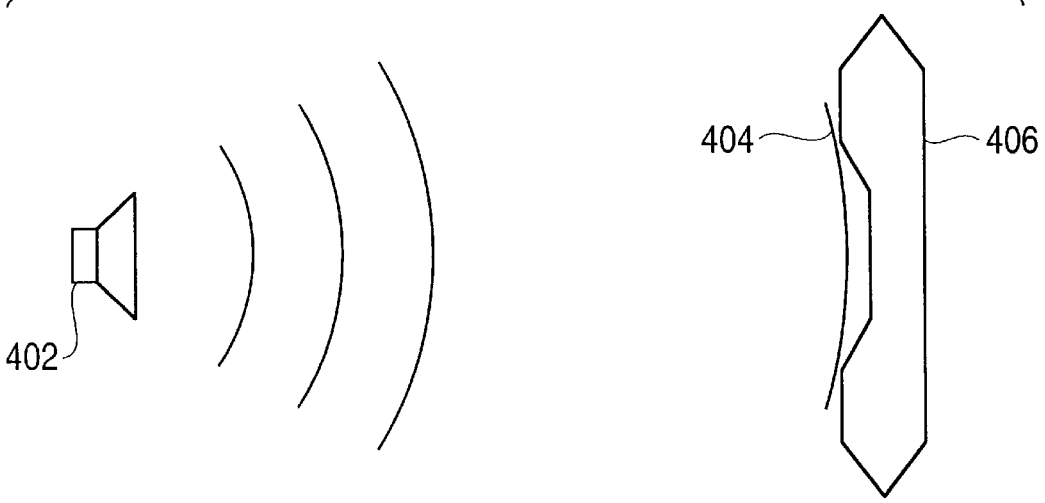
FIG. 4a (PRIOR ART)
FIG. 4*a* illustrates the response of a conventional microphone under normal operating conditions.

FIG. 4*a* shows operation, within a specified dynamic range, of a conventional microphone, having a membrane 404 and a substrate 406. A sound source 402 creates sound waves which cause the membrane 404 to vibrate within area 405. An output electrical signal is generated by the microphone. The signal is transmitted to an apparatus such as an amplifier driving a loudspeaker (Not shown). The amplifier and loudspeaker convert the electrical signal to sound waves corresponding to those incident on the membrane 404.

Figure 4B:
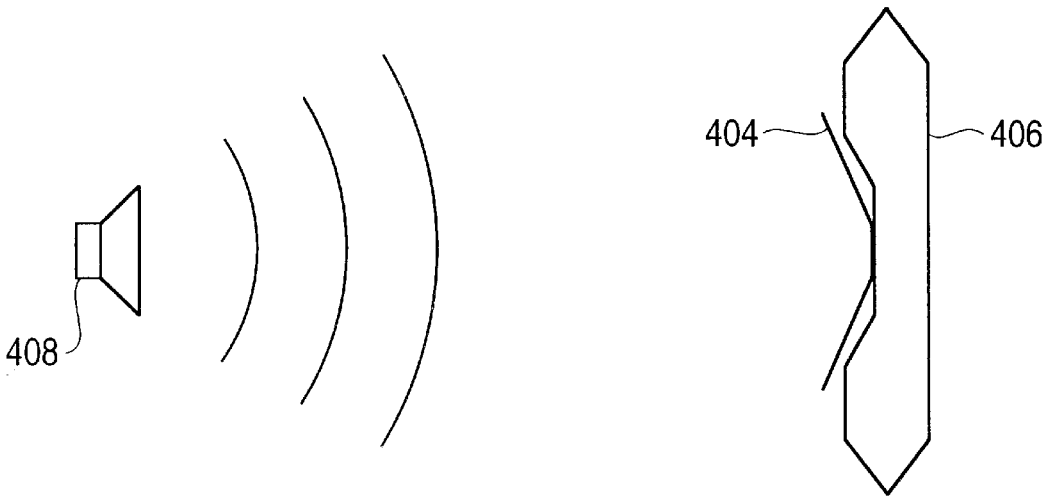
FIG. 4b (PRIOR ART)
FIG. 4*b* illustrates the response of a conventional microphone when over-driven.
Figure 4C:
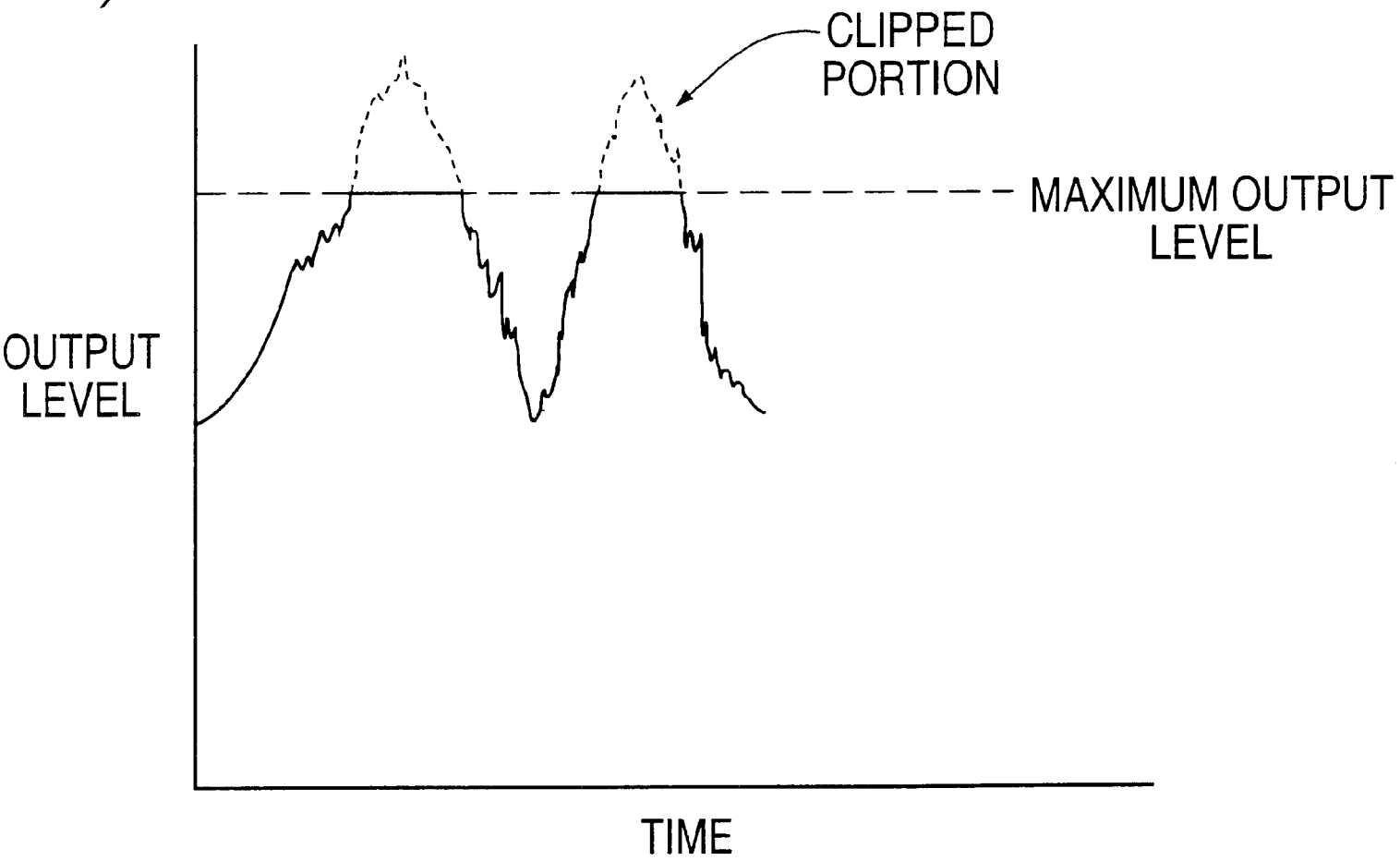
FIG. 4c (PRIOR ART)
FIG. 4*c* is a graphical representation of "clipping;"

FIG. 4*b* illustrates the response of the membrane 404 to a sound source 408 when the sound waves exceed the maximum SPL of the microphone. The effect shown is that of the membrane 404 being over-driven and contacting the substrate 406, thus creating a phenomenon known as "clipping." A graphical representation of clipping is shown in FIG. 4*c*. Clipping is also possible without physical contact between the membrane 404 and the substrate 406. Such clipping occurs when the membrane 404 is fully flexed. In this case the capacitance between the membrane 404 and the substrate 406 remains constant and can not vary until the sound pressure level drops below the clipping threshold. As shown in FIG. 4*c*, during clipping the electrical signal produced is clipped at the maximum possible output level. The effect on the listener is distortion of amplitude, noise-level, and harmonic content of the signal, resulting in reduced intelligibility.

Figure 5A:
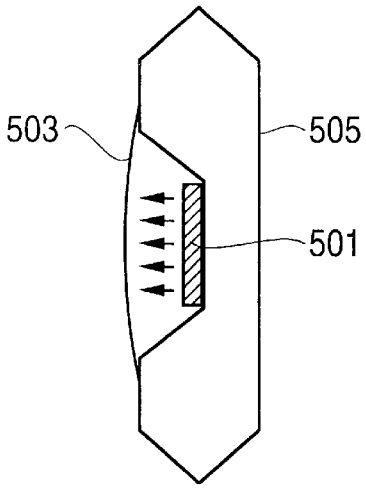
FIG. 5*a* shows a microphone according to the invention.
Figure 5C:
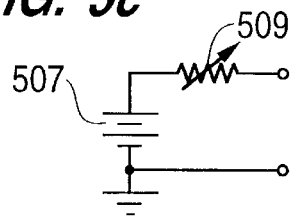
FIG. 5*c* shows representative charge applying circuitry according to the invention.
Figure 5B:
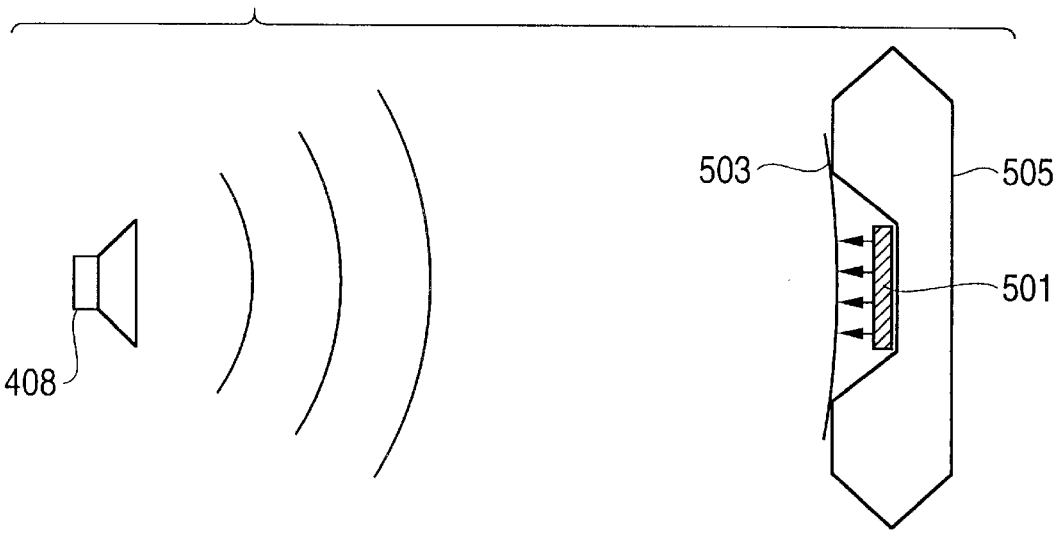
FIG. 5*b* shows the response of the microphone of FIG. 5*a* under the same sound conditions shown in FIG. 4*b;*

FIGS. 5*a* and 5*b* show a microphone according to the invention in normal operation having a membrane 503, a substrate 505, and a charge carrying circuit 501. Two charged surfaces spaced apart, one having a positive charge relative to the other, form a capacitor. Thus, membrane 503 and substrate 505, when charged this way, form a capacitor. It is known that charge carrying circuits with opposite polarization in close proximity have an attractive force with respect to each other while circuits with like polarization have a repulsive force. According to the invention, a positive charge or a negative charge can be applied to the circuit 501. Such a charge can be applied, for example, by connecting charge carrying circuit 501, through appropriate circuitry, to a power source.

Representative appropriate circuitry is shown in FIG. 5*c* wherein a voltage source 507 is connected in series with a variable resistor 509. A variation of the compliance is achieved by varying a resistance of the variable resistor 509.

FIG. 5*a* shows the effect of applying a charge to the charge carrying circuit of like polarization with respect to the charge on the diaphragm. The circuit 501 creates a repulsive force on membrane 503, thereby stressing membrane 503 and rendering the membrane 503 less compliant or more resistant to deflection from impinging sound waves than the membrane 503 would be without the charge applied.

FIG. 5*b* shows the response of the microphone of FIG. 5*a* to a sound source 408 with sound waves identical to the sound waves of FIG. 4*b*. Unlike the case shown in FIG. 4*b*, in FIG. 5*b* the stressed membrane 503 does not contact the substrate 505 because the charge applied to the charge carrying circuit 501 increases the resistance of the membrane to movement in response to impinging sound waves. This increased stiffness provides a higher maximum SPL thereby reducing clipping and distortion.

A further advantage of a microphone according to the invention is that the maximum SPL can be varied by varying the charge on the charge carrying circuit 501. The microphone of the invention in FIG. 5*a* can operate identically to the microphone of FIG. 4*a* with no charge applied to the charge carrying circuit. This absence of charge might be useful in low volume situations. However, the microphone of FIG. 4*a* has fixed operating characteristics. The microphone according to the invention can further operate as in FIG. 5*b* with an appropriate charge applied to dynamically change the operating characteristics, for example, to avoid clipping in response to loud sounds.

The amount of charge applied to the charge carrying circuits of any of the embodiments herein can be tailored for particular situations and can be dynamically altered so that the same microphone can be optimized, by varying the charge applied to the charge carrying circuit, for use in an environment with variable conditions. In the previous example of a noisy factory floor which is occasionally quiet, a microphone according to the invention could be utilized such that no charge is applied under quiet conditions, optimizing the microphone for a user speaking in a normal voice, while a charge is selectively applied when the factory floor is noisy, thereby raising the maximum SPL characteristic of the microphone and optimizing the microphone for a user who is shouting.

It should also be understood that certain trade-offs are involved in rendering the diaphragm less compliant. While a stiffer diaphragm can handle louder sounds without distortion, it also requires louder sounds to move the diaphragm against the stronger restoring forces. Thus increasing the maximum SPL characteristic of the microphone creates a corresponding, although not necessarily proportional, increase in the minimum SPL characteristic.

Figure 6A:
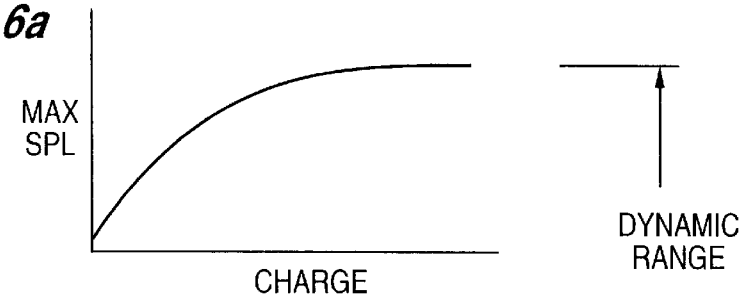
FIG. 6*a* shows a graph of maximum SPL versus charge for a microphone according to the invention.

FIG. 6*a* shows a graph of the general relationship between maximum SPL of the microphone and the amount of charge applied to the charge carrying circuit, such as 202, 252, 301, and 501, of FIGS. 2*b*, 2*c*, 3, and 5*a* respectively. FIG. 6*a* shows that the maximum SPL characteristic of the microphone can be increased by increasing the charge applied to the charge carrying circuit. Furthermore, the maximum SPL characteristic can be controlled by coupling the microphone with circuitry which can dynamically vary the charge applied to the charge carrying circuit based on the particular application and conditions. The operating characteristics can be controlled by any of a variety of means. For example, a user via a user interface, such as a dial connected to a variable resistor can vary the voltage applied to the charge carrying circuit by varying the resistance. Another method of controlling the microphone is coupling to a separate microphone that detects changes in operating conditions or is tuned to specific ranges of volume and/or frequency.

Alternatively, the microphone itself can use a feedback loop or other control process to set the microphone characteristics. A more sophisticated system could use predictive techniques to dynamically vary the characteristics. For example, in an industrial environment where there is a repetitive banging of machinery, the control circuit could vary the characteristics of the microphone in accordance with the predicted repetition of the sound.

Figure 6B:
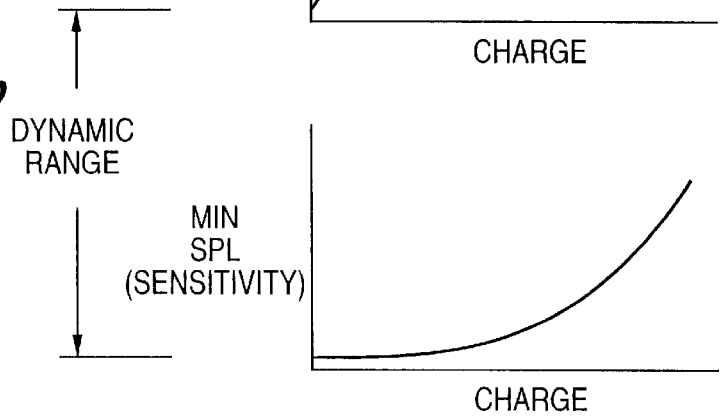
FIG. 6*b* shows a graph of minimum SPL versus charge for a microphone according to the invention.

As described above, increasing the maximum SPL typically involves stiffening the compliance of the membrane with a corresponding increase in the minimum SPL characteristic of the microphone. The difference between the maximum SPL and the minimum SPL defines the dynamic range characteristic of the microphone. FIGS. 6*a* and 6*b* which also show the relationship between maximum SPL and minimum SPL for various levels of charge applied to the charge carrying circuit, thereby show the varying dynamic range. As shown in FIGS. 6*a* and 6*b*, the maximum SPL and minimum SPL do not necessarily vary to the same degree for a given change in the charge applied.

Figure 6C:
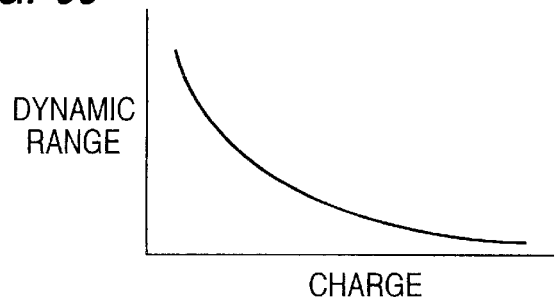
FIG. 6*c* shows a graph of dynamic range versus charge for a microphone according to the invention.

Further, as is shown in FIGS. 6*b* and 6*c*, the minimum SPL and dynamic range characteristics of the microphone can also be controlled using methods similar to those described above with respect to controlling the maximum SPL characteristic. Of course, each of the characteristics cannot be varied independently of the others, as all of these characteristics are a function of the compliance of the diaphragm and therefore vary in accordance with a variance of the charge applied to the charge carrying circuit.

Figure 7:
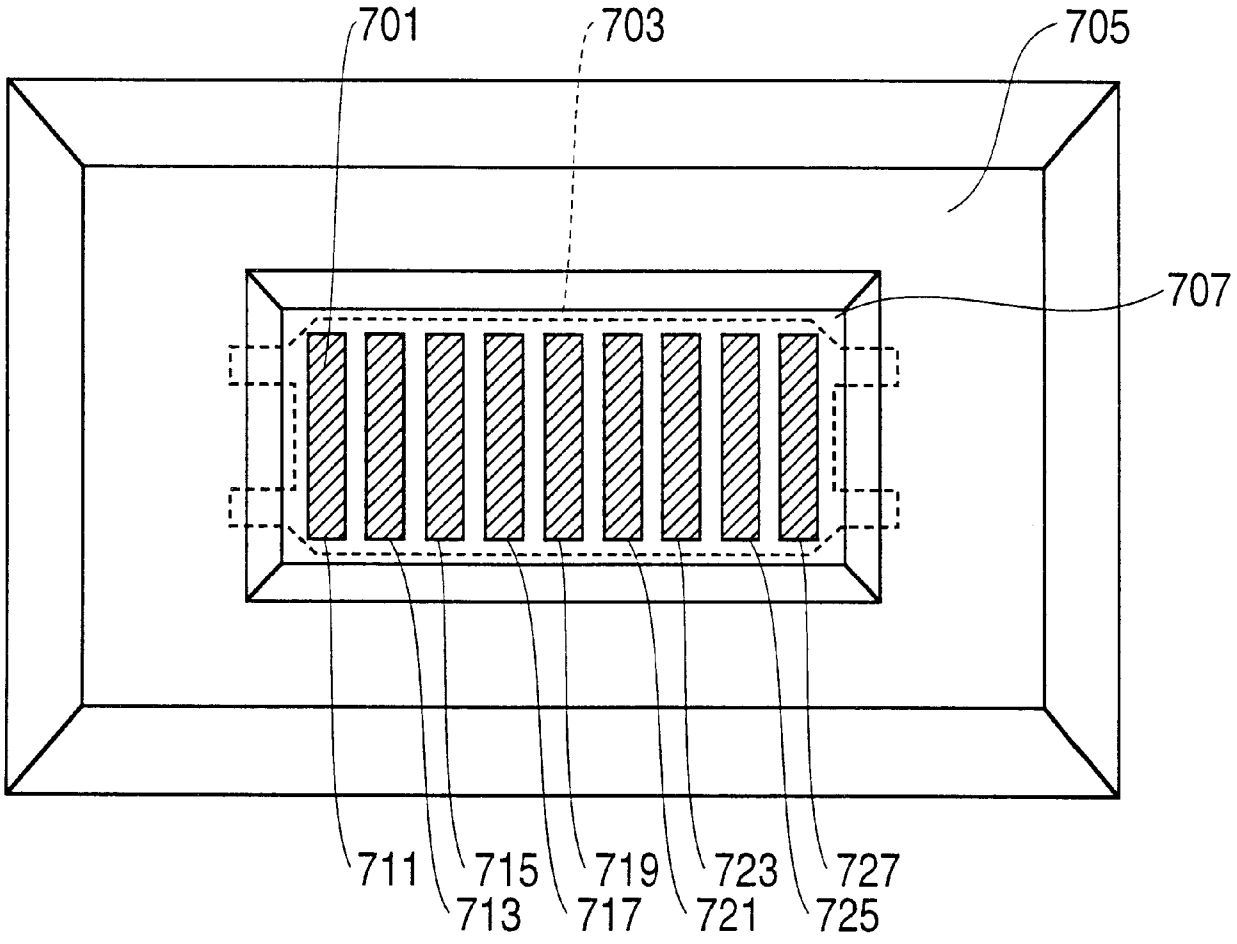
FIG. 7 is a top view of a fourth embodiment according to the invention.

The frequency response of a microphone according to the invention is an additional operating characteristic that can be controlled by applying a charge to the charge carrying circuit in accordance with the invention. The length of the diaphragm is related to the frequency response of the microphone. FIG. 7 shows a fourth embodiment according to the invention particularly suited to dynamically control the frequency response of the microphone. This embodiment includes a substrate 705, a membrane 703, and a charge carrying circuit 701 positioned in a depression 707. The charge carrying circuit 701 includes charge carrying strips 711, 713, 715, 717, 719, 721, 723, 725, and 727 which are of substantially equal width and spacing. Other numbers of strips and variations of widths and spacing are of course possible.

An advantage is provided by the ability to selectively charge individual strips with various degrees of charge. A charge applied only to strip 711 applies a force principally to the leftmost edge of the membrane 703. The leftmost edge of the membrane 703 would be relatively stiff compared the portion to the right of the charged strip 711. Thus, the effective length of the membrane 703 which is not restricted from vibration would be decreased. The frequency response can thereby be controlled by selectively charging the strips to control the effective length of the membrane 703 which is left free to vibrate.

In general, FIGS. 7*a*–7*d* represent various frequency responses of a microphone according to the invention. In each of these figures, the x-axis represents frequency shown logarithmically from 20–10,000 Hz. The y-axis represents the output electrical signal of the microphone in response to a broad band input signal containing representative sound wave frequencies from 20–10,000 Hz at a constant sound pressure level. As shown, the microphone functions essentially as a band pass filter wherein only certain frequencies of all those present in the input sound wave are present in the output electrical signal.

Figure 7A:
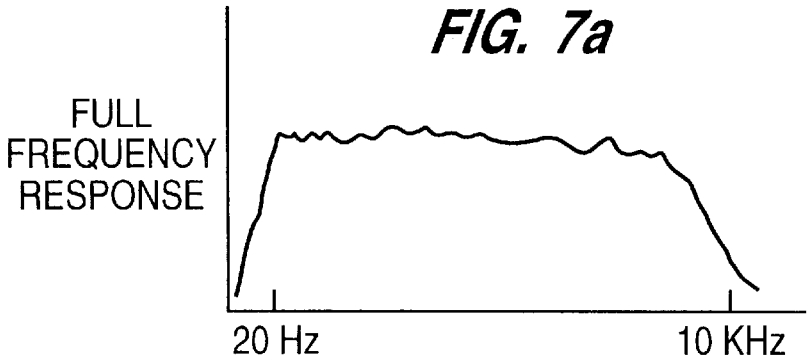
FIG. 7*a* illustrates a first frequency response for a microphone according to the invention.

FIG. 7*a* shows the full frequency response projected for a microphone formed according to the invention in the absence of any charge applied to the charge carrying circuit. Such a frequency response characteristic is similar to that of a prior art microphone, such as the microphone of FIGS. 4*a* and 4*b*.

Figure 7B:
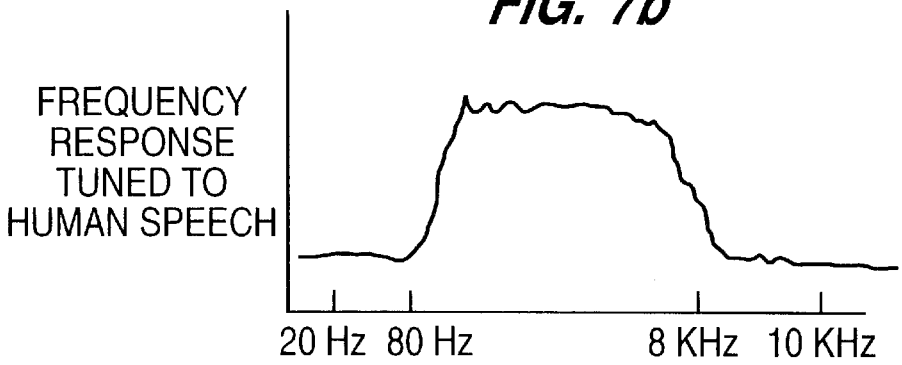
FIG. 7*b* illustrates a second frequency response for a microphone according to the invention.
Figure 7C:
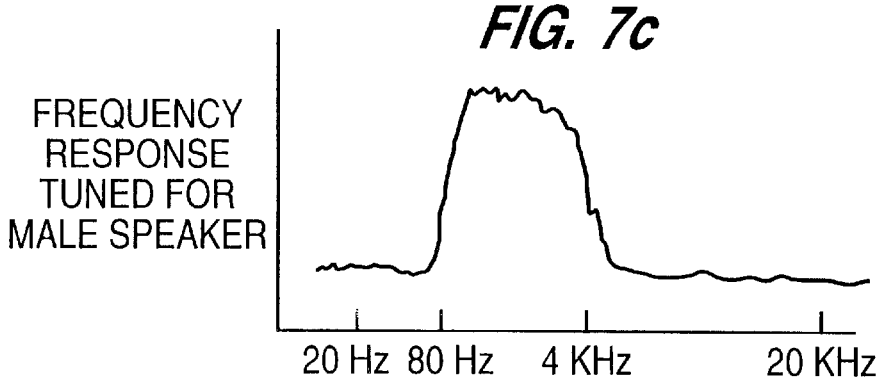
FIG. 7*c* illustrates a third frequency response for a microphone according to the invention.
Figure 7D:
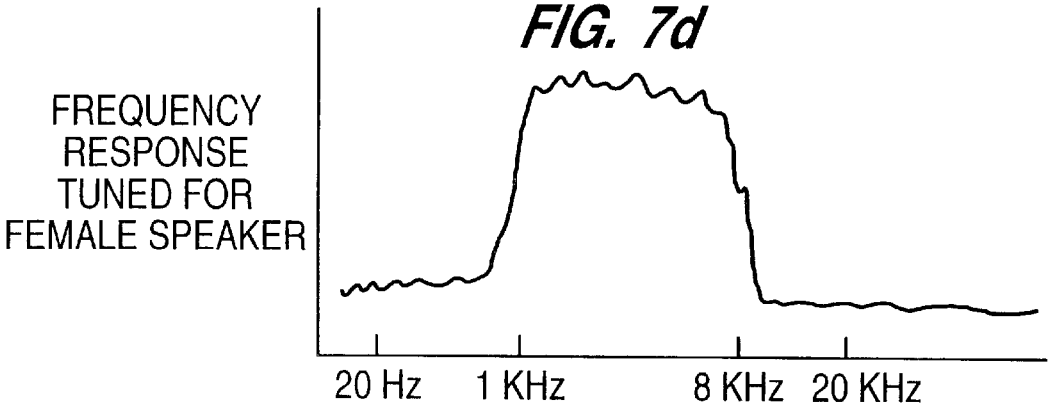
FIG. 7*d* illustrates a fourth frequency response for a microphone according to the invention.

It is sometimes desirable to tailor the frequency response of a microphone. FIG. 7*b* shows an example of the projected frequency response for a microphone formed according to the invention when a charge is applied to the charge carrying circuit. The frequency response of FIG. 7*b* is tuned to the normal range of human speech. FIG. 7*c* shows the frequency response further limited to a narrower band corresponding to a speaker with a low voice. FIG. 7*d* shows the frequency response limited to a speaker with a high voice.

Figure 8:
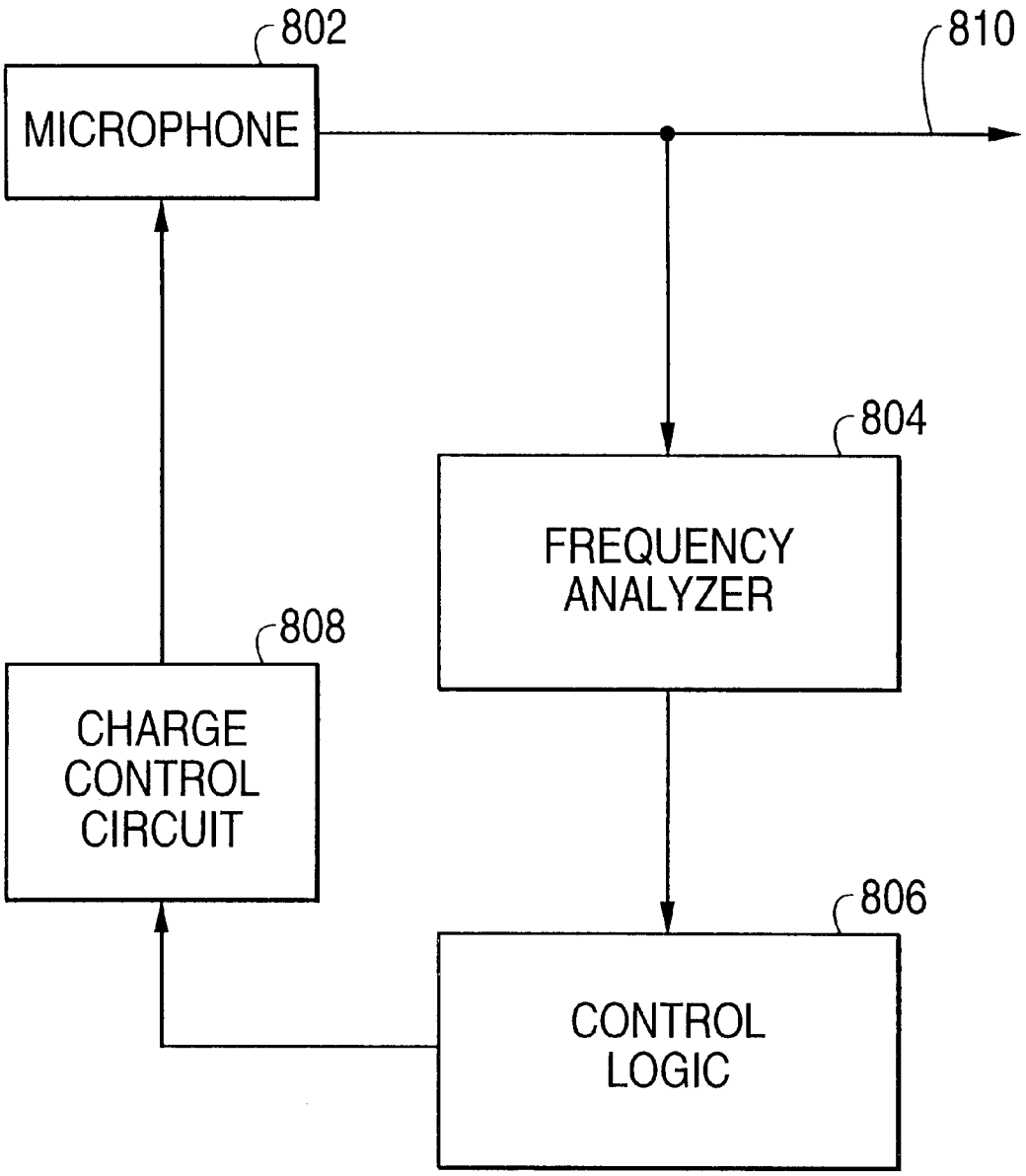
FIG. 8 shows a block diagram of a frequency response control system according to the invention.

FIG. 8 shows a microphone according to the invention connected to a feedback control loop for adjusting its frequency response. The microphone 802 has an output signal 810. The output signal 810 can be sampled by a frequency analyzer 804 to determine the frequency range of the sampled sound. Information from the frequency analyzer 804 is supplied to control logic 806 which is connected to a charge control circuit 808. The charge control circuit 808 can adjust the frequency response of the microphone 802 according to the methods described above.

The feedback loop in FIG. 8 would typically sample at discrete intervals under user control. For example, a user would want to set the tuned frequency response when the office is quiet with few or no other sounds present.

A user can thus vary the frequency response characteristics of the microphone by varying the charge applied to the charge carrying circuits 202, 252, 301, and 501 in each of the above embodiments of the invention. Of course, as mentioned earlier, each change in a frequency response would yield a change to the maximum SPL, minimum SPL, and dynamic range characteristics of the microphone, since each of these characteristics is affected to some degree by the a change in the charge applied by the charge carrying circuit. Thus, a microphone according to the invention enables an operator to optimally set the microphone according to the operational environment and objectives, recognizing that optimizing one characteristic may yield trade-offs in other characteristics.

It will be understood that various modifications in the form of the invention as described herein and its preferred embodiments may be made without departing from the spirit thereof and of the scope of the claims which follow.

What is claimed is:

1. A microphone system including a first and a second microphone, comprising:

a diaphragm mounted in said first microphone to vibrate in response to sound waves; and means for dynamically controlling a compliance of said diaphragm by applying a charge in order to increase a dynamic range of the first microphone, wherein said second microphone detects a sound level of an environment in which the microphone system is located, and wherein the detected sound level is used by the dynamically controlling means to apply the charge in an appropriate amount.

2. A microphone as recited in claim 1, wherein said control means comprises:

a charge carrying surface positioned proximate to said diaphragm to dynamically control a compliance of said diaphragm.

3. A microphone system including a first and a second microphone, comprising:

a compliant diaphragm mounted in said first microphone to vibrate in response to sound waves;

a surface disposed in said first microphone and positioned proximate to the diaphragm to form a variable capacitance with respect to said diaphragm, the variable capacitance being proportional to the sound waves vibrating said diaphragm;

circuitry disposed in said first microphone for producing a signal proportional to the sound waves, whereby the diaphragm, the surface, and the circuitry form a sound transducer with an operating characteristic;

a charge carrying circuit disposed in said first microphone and positioned proximate to the diaphragm such that a charge applied to the charge carrying circuit controls a compliance of the diaphragm, thereby controlling the operating characteristic of the sound transducer; and a charge control circuit disposed in said first microphone to control the charge applied to the charge carrying surfaces, wherein said second microphone detects a sound level of an environment in which the microphone system is located, and wherein the detected sound level is provided as a signal to said charge control circuit to control the charge applied to the charge carrying surface.

4. A micromachined microphone system including a first and a second microphone, comprising:

a compliant silicon membrane mounted in said first microphone to vibrate in response to sound waves;

a substrate to which said membrane is mounted at points on a periphery thereof, the substrate having a depression within the periphery of the membrane;

circuitry disposed in said first microphone for producing a signal proportional to the sound waves, whereby the membrane, the substrate, and the circuitry form a sound transducer with an operating characteristic;

a plurality of concentric charge carrying rings positioned in the depression between the substrate and the membrane such that a charge applied to at least one of the rings creates a force on the membrane, thereby controlling the operating characteristic of the sound transducer; and a charge control circuit disposed in said first microphone to control the charge applied to the rings, wherein said second microphone detects a sound level of an environment in which the microphone system is located, and wherein the detected sound level is provided as a signal to said charge control circuit to control the charge applied to the rings.

5. A method of dynamically controlling a dynamic range of a microphone including a compliant diaphragm mounted therein to vibrate in response to sound waves, said method comprising the step of:

determining a sound level of signals previously applied to the microphone;

applying a charge to a proximately positioned charge carrying circuit in order to vary a compliance of the diaphragm thereby to improve the dynamic range of the microphone, based on the determined sound levels of the signals previously applied to the microphone.

6. The method of claim 5, wherein the step of applying a charge comprises:

applying a charge of opposite polarity with respect to the diaphragm.

7. The method of claim 5, wherein the step of applying a charge comprises:

applying a charge of like polarity with respect to the diaphragm.

8. A method of manufacturing a microphone, including a compliant diaphragm vibrating in response to sound waves, to have a dynamically controllable operating characteristic, the method comprising the steps of:

positioning a charge carrying circuit sufficiently proximate to the compliant diaphragm such that a charge applied to the charge carrying circuit varies a compliance of the compliant diaphragms;

wherein the charge is applied such that the compliance is greater when the microphone is used in a quiet environment, and the compliance is lower when the microphone is used in a loud environment, thereby controlling the operating characteristic of the microphone.

9. A microphone, comprising:

a substrate having a top surface and side walls extending inward to a bottom surface to form a depression in the substrate, the bottom surface of the depression having a first charge;

a flexible member positioned over the depression and supported at its periphery by the top surface of the substrate, the flexible member having a second charge different from the first charge, such that the bottom surface of the depression and the flexible member form a capacitor;

a charge carrying circuit positioned proximate to the flexible member, such that a charge applied to the charge carrying circuit imparts a force in a first direction on the flexible member; and a capacitance sensing circuit connected to the bottom surface of the depression and the flexible member and producing electrical signals proportional to the sensed capacitance, wherein a change in the charge applied to the charge carrying circuit results in a change in the force applied in the first direction to the flexible member, correspondingly varying an operational characteristic of the microphone, and wherein the flexible member is deflected in an opposite direction than the first direction by sound waves incident upon the flexible member and the electrical signals produced by the capacitance sensing circuit correspond to the deflections of the flexible member.

10. A microphone as recited in claim 9, further comprising means for setting the charge applied to the charge carrying circuit to thereby set the operational characteristic of the microphone.

* * * * *